United States Patent [19]

Panetti

[11] 4,091,578

[45] May 30, 1978

[54] PROCESS AND APPARATUS FOR TRUING THE HEAD OF RAILS OF A RAILWAY

[75] Inventor: Romolo Panetti, Geneva, Switzerland

[73] Assignee: Speno International S.A., Geneva, Switzerland

[21] Appl. No.: 754,009

[22] Filed: Dec. 27, 1976

[30] Foreign Application Priority Data

Jan. 7, 1976 Switzerland ..... 000094/76

[51] Int. Cl.[2] ..... B24B 23/00

[52] U.S. Cl. ..... 51/178; 51/326

[58] Field of Search ..... 51/178, 281 R, 327, 51/326

[56] References Cited

U.S. PATENT DOCUMENTS

| | | | |
|---|---|---|---|
| 2,779,141 | 1/1957 | Speno, Jr. et al. | 51/178 |
| 3,606,705 | 9/1971 | Rivoire | 51/178 |

*Primary Examiner*—Harold D. Whitehead

*Assistant Examiner*—Roscoe V. Parker

*Attorney, Agent, or Firm*—Haseltine, Lake & Waters

[57] ABSTRACT

A process and apparatus for on-track truing of the surfaces of the head of a rail in which a predetermined number of grinding tools are positioned with respect to the rail to operate along a tangent to the profile of the head of the rail, the tools being suspended by jacks from a vehicle which travels along the rail and carries the tools therewith. The metal-removing ability of at least one of the grinding tools is directly or indirectly controlled by means of a set control value which is pre-established as a function of the desired cutting depth of the tool. In a particular arrangement, the hydraulic feed circuit supplying the tool contains a pressure regulating device with a control member for setting the pre-established value so that the jack will keep the tool in bearing pressure with the rail at a constant value while the tool is driven at a constant speed and with constant driving torque.

12 Claims, 6 Drawing Figures

IV
III
II
I
48
49
34
31
38
32
33
35
50
52
47
51
44
46
53
45
43
42
26

34
65
33
63
64
57
54
58
56
61
60
55
62
59

PROCESS AND APPARATUS FOR TRUING THE HEAD OF RAILS OF A RAILWAY

FIELD OF THE INVENTION

The present invention relates to a process and apparatus for on-track truing of the surfaces of the head of the rails of a railway.

BACKGROUND

The continuous increase in the speed and in the frequency of train traffic brings about conditions that are increasingly rigid regarding maintaining the quality of the roadbed.

A good roadbed is the first condition of this quality since the economy, the comfort and the safety of the trains depend on it.

Periodic filling of the roadbed sleepers, straightening and levelling of the track, tightening of the rail fasteners to a large extent contribute to the maintenance of the roadbed, but these operations are not completely sufficient to ensure this maintenance because the stresses developed by the rolling equipment subject the head of the rails to very severe wear which causes its deformation.

This deformation, to which both the longitudinal and transverse profiles of the head of the rails are subjected, spreads over the rail tread and its bead and it has the effect of creating vibrations and impact which reach both the rolling equipment and the roadbed. As a result, fatigue of the rolling equipment is increased and, in turn, destruction of the track and its roadbed is accelerated. Furthermore, the vibrations and impact resulting from this deformation produce noise which adversely affects the comfort of the travelers and of people in the vicinity of the roadbed.

It is, therefore, also necessary for the maintenance of railways to periodically true the worn out and deformed surfaces of the head of the rails to retain its rolling quality in order to avoid the above-mentioned disadvantages.

Processes are already known for the truing of the worn surfaces of the heads of rails which comprise displacing, at generally constant speed along the generatrics of such surfaces, a predetermined number of grinding tools angularly oriented in a plane perpendicular to the rail and each operating along a tangent to the transverse profile of the rails, in such a manner as to obtain, after a certain number of cuts, a head which is trued according to an outline which is as close as possible to the ideal profile, at least in its working portions; the tread, the bead and the inner face of the rail.

This arrangement of the grinding tools, at different inclinations according to their position about the rail head, causes the component of their own weight which is perpendicular to their working tangent, to vary from one position to the other and the result of this condition is to proportionally increase or decrease the bearing force which is applied on such tools. Furthermore, for the same bearing force, the cutting depth of the grinders is not the same according to the orientation of the working tangent which may contact the profile of the head over surfaces that are more or less extensive, depending on the radius of curvature of such surfaces. Thus, a grinding tool operating tangentially over the tread, which is almost flat, penetrates into the metal less than a tool working tangentially over the head, which is round. Finally, it must also be considered that depending on the shape of the track, from straight stretches to small radius curves, the areas of maximum wear of the head of the rails are not the same and it is sometimes the tread and sometimes the bead that are most damaged.

All these considerations sometimes make it necessary to adjust the bearing pressure of the grinding tools for each position of the latter about the profile of the head of the rails to follow the prescribed shape of its profile. It is also necessary to adjust the bearing pressure of all the grinding tools of a stretch of rails differently from that of all the grinding tools of another stretch in the case, for instance, of curves where the inner stretch is more often affected by the rolling material.

All these adjustments are presently carried out manually by operators and the quality of the adjusted grinding operation depends exclusively on the skill and the experience of such operators. In view of the large number and complexity of such adjustments, it can easily be understood that they give rise to difficult problems.

SUMMARY OF THE INVENTION

An object of the present invention is to provide a process for on-track truing of the worn out surfaces of the heads of rails in which these problems are in large measure solved by making automatic the adjustment of the metal removing ability of the grinding tools taken individually or by group according to their positions, or else by stretch of rails, or yet for the complete set of tools.

To this end, the process is characterized in that the value of at least one of the parameters acting on the metal removing ability of at least one of the grinding tools, such as the bearing force, the driving torque, the power, the number of revolutions, is directly or indirectly governed by a set of control value which is pre-established as a function of the desired cutting depth of the said tool.

In this manner, simply by setting the control value of the said selected parameter for each tool or for each group of tools, uniformity in the desired cutting depth for each of the said tools is automatically ensured.

Within the scope of this general process and to meet the aforementioned requirements, it is advantageous to tie to the same control value the selected parameter acting on the metal removing ability of all the tools working on the same stretch of rails, in order to reduce the difference in wear between the two stretches whenever it exists.

In a preferred embodiment of the process according to the invention, it is the bearing pressure of the grinding tools over the head of the rails that is governed by a control value, either directly or indirectly, through the value of the resisting torque of the grinding tools.

The invention also contemplates a grinding train for carrying out the grinding process, of a known type comprising at least one grinding vehicle having a power unit and a predetermined number of grinding tools necessary for truing the profile of the head of the rails of the railway travelled by the train wherein the grinding tools are connected to the power unit by at least one feed circuit containing a device for controlling the said tools, characterized in that the feed circuit comprises at least one device directly or indirectly relating the value of at least one parameter, depending on said feeding circuit and acting on the metal removing capacity of at least one of the grinding tools, to a control value which is pre-established as a function of the desired cutting depth of the said tool, said device comprising a member for setting the control value.

To satisfy the preferred embodiment of the process in which it is the bearing force of the grinding tools that is being governed or controlled, three embodiments of the grinding train are contemplated in which the grinding tools are suspended from the frame of the grinding vehicle.

In the first embodiment of this grinding train, the circuit feeding the grinding tools is a hydraulic circuit comprising, in conventional manner, a tank, a filter, a hydraulic pump for feeding the fluid having a generally constant pressure $P_1$ to the hydraulic motor of each guiding tool. This first embodiment is characterized by the construction in which there are connected, in the circuit joining the pump and the motor of each grinding tool, on the one hand, the lower chamber and, on the other hand, the upper chamber of a hydraulic jack from which the said grinding tool is suspended, and in that the circuit connecting one of the two chambers of the said jack to the said pump passes through a pressure control valve having a member for setting a control pressure $P_2$ which is a function of the desired bearing force for the said grinding tool over the head of the rail.

In this first embodiment, the bearing force of the grinding tool is indirectly related to a control value through the resisting torque of the grinding tool which serves as correcting data, the effect of which is to momentarily reduce the bearing force of the grinding tool when an accidental increase in the resisting torque of the tool occurs.

In the second embodiment of the grinding train, of which the basic circuit is identical to that of the first embodiment, the setting member of the valve controlling the pressure of the suspension jack of each grinding tool is connected by a feedback control circuit to a differential pressure regulator bridge-connected to the two inlet circuits of the lower and the upper chambers of the said hydraulic jack, said differential regulator comprising a member for setting a control pressure differential ($\Delta = P_1 - P_2$) which is a function of the desired bearing force of the grinding tool on the head of the rail.

In this second embodiment, the bearing force of the grinding tool, directly related to the difference in pressure in the two chambers of the suspension jack, is no longer influenced by the accidental increases in the resisting torque of the grinding tool and remains unchanged due to the fact that this difference in pressure is set as the control value.

Finally, in the third embodiment of the grinding train according to the invention, the grinder of each of the tools is driven by a synchronous motor having a generally constant rotation speed whereas suspension of the grinding tools is effected, as in the first two embodiments, by hydraulic jacks. The hydraulic feed circuit of such jacks comprises a tank, a filter, a hydraulic pump, a hydraulic accummulator connected to a device for actuating and deactuating the pump and a first pressure control valve comprising a setting member for a pressure $P_1$. The outlet of this first valve is connected, on the one hand, to the lower chamber and, on the other hand, through a second pressure control valve, to the upper chamber of the suspension hydraulic jack of each grinding tool. This second pressure control valve comprises a setting member for a pressure $P_2$, and the pressures $P_1$ and $P_2$ are dependent upon a pressure differential $\Delta = P_1 - P_2$ which is a function of the desired bearing pressure of said grinding tool on the head of the rail.

This third embodiment allows, like the preceding one, grinding at a substantially constant cutting speed and at an invariable bearing pressure but with the assistance of a hydraulic circuit feeding the suspension jacks of the grinding tools which are of relatively small size and power due to their very restricted flow. It further allows, simply by changing the setting of the first pressure control valve of the basic power circuit, to vary by an equal value, the bearing pressure of the complete set of tools connected to the basic circuit. This feature makes it possible to practice advantageously the process according to which the same control value is related to the selected parameter acting on the same stretch of rails.

Finally, in the case where operation of the grinders of the grinding tools is effected at their peripheries, it is advantageous, in order to ensure a constant cutting speed, to relate their tangential speed to a control value by varying their rotational speed as a function of the reduction in their diameter as they gradually wear out. For this purpose, the feed circuit of a grinding tool of this type includes a device related to the peripheral speed of its grinder comprising a member sensitive to variations in the diameter of said grinder, such as a space detector mounted in parallel with the suspension system of the grinding tool, connected to a speed changer for varying the rotational speed of the motor of the grinder responsive to the signal of the space detector.

BRIEF DESCRIPTION OF THE DRAWING

The appended drawing shows, by way of example, various embodiments of a grinding train according to a preferred embodiment of the process in which the bearing force of the grinding tools on the rails of the railway is controlled.

DETAILED DESCRIPTION

Figure 1:
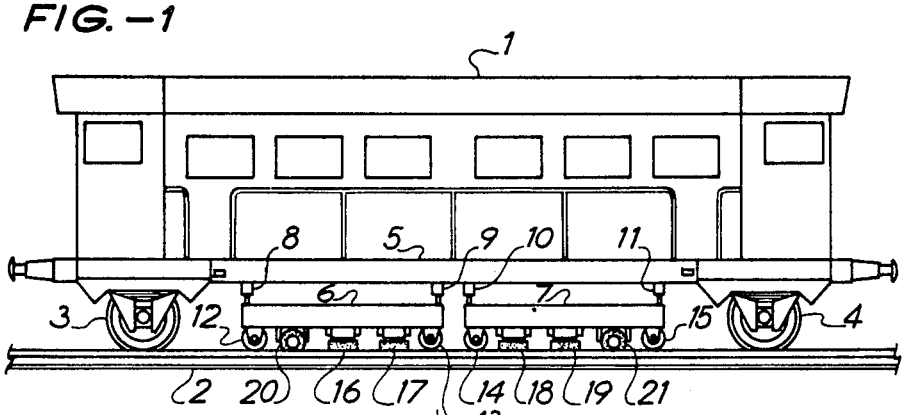
FIG. 1 is an elevation view of a grinder vehicle of the grinding train.

FIG. 1 illustrates a grinding vehicle 1 travelling on the rails 2 of a railway on which it rests by means of two axles 3 and 4. This vehicle has a power unit that provides the energy necessary for the actuation and the control of the grinding tools. It may be self-propelled or drawn by a locomotive.

Over each stretch of rails, between the two axles and beneath the frame 5 of the grinding vehicle, are mounted two grinding units 6 and 7 connected to the frame 5 by telescopic suspensions such as hydraulic jacks 8, 9, 10 and 11 which place them in and out of service by lowering and raising the grinding units. These grinding units rest on the track, in working position, by guiding rollers 12, 13, 14 and 15.

On these grinding units are mounted, for each length of rails, six grinding tools having cylindrical grinders operating through their side faces of which four, numbered 16, 17, 18 and 19, are progressively oriented to follow the profile of the tread of the railhead and two, numbered 20 and 21, to follow the profile of the lateral face of the said head.

Figure 2:
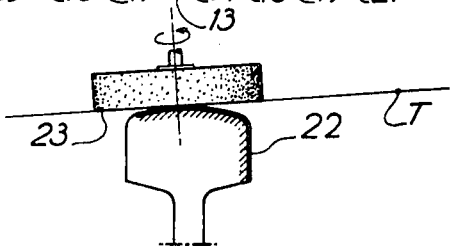
FIG. 2 is a cross-sectional view of a rail wherein the area over which the grinding tools operate is shown in heavy outline and is hatched.

Depending on the degree of reshaping accuracy it is desired to apply to the railhead to be trued, several grinding vehicles may be integrated in the grinding train whereby to make use of the necessary number of grinders to cover, as much as possible, the usual wear zones of the head of the rails, such as shown at 22 in FIG. 2 in heavy outline and hatched.

It is to be understood, from FIG. 2, that since each grinder 23 operates along a tangent T to the profile of the head, the greater the number of grinders the more it becomes possible to obtain a reshaping which comes closest to the ideal profile by reducing the difference in orientation between each grinder and the next one about said profile.

Figure 3:
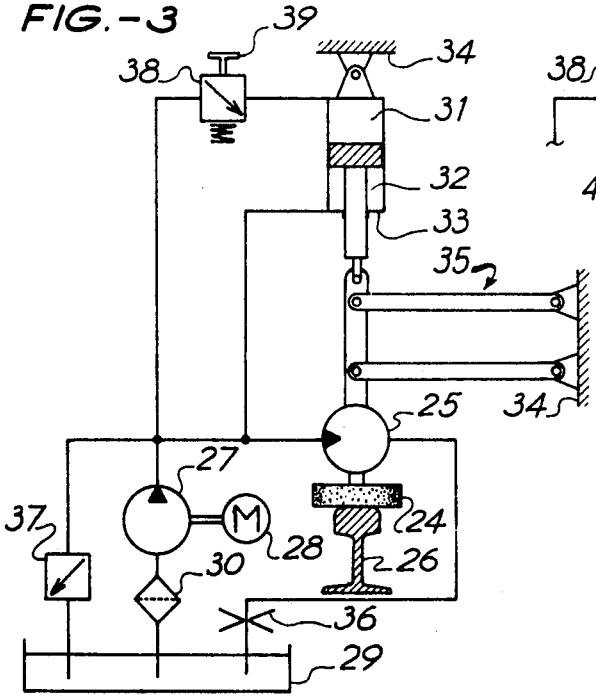
FIGS. 3, 4 and 5 are diagrammatic illustrations of three embodiments of control and feeding circuits of the grinding tools.

In FIG. 3 diagrammatically illustrating the complete feeding and control circuit of a grinding tool according to the first embodiment, there is shown a grinding tool comprising a cylindrical grinder 24 by a constant capacity hydraulic motor 25. This tool is of the same type as tools 16, 17, 18 and 19 illustrated in FIG. 1 machining the tread of the head of the rail 26 in FIG. 3.

The grinding tool motor 25 is fed by a constant capacity hydraulic pump 27 driven by an electric motor 28. This hydraulic pump 27, drawing the fluid from a tank 29 through a filter 30, feeds it under a substantially constant pressure $P_1$ both into the upper chamber 31 and the lower chamber 32 of a hydraulic jack 33 holding the grinding tool in suspension. The jack and the grinding tool are articulated to a swiveling support 34, which is part of the grinding unit. This swiveling support may be of any kind capable or orienting the grinding tool according to the desired tangent.

The articulation support of the grinding tool is effected by a linkage 35 of parallelogram type in order that the machining angle of the grinder may not vary during vertical oscillations of the tool.

The return piping of the motor 25 to the tank 29 includes a throttle 36 to prevent racing of the motor whenever its resisting torque is appreciably reduced, an outlet or check valve 37 being provided in the feeding circuit as a safeguard in case of overload.

In the feed pipe for the upper chamber 31 of the jack there is mounted a pressure regulating valve 38 for delivering an output pressure $P_2$ adjustable by means of a setting member 39. This pressure $P_2$ is necessarily equal to or smaller than pressure $P_1$.

This pressure $P_2$ is determined as a function of the desired bearing force F of the grinding tool on the rail, the weight Q of the combination tool-articulation-piston and the pressure $P_1$ of the circuit being taken into account.

In this first embodiment, any increase in the resisting torque of the grinder motor 25, due, for instance, to a significant defect of short rail undulation, causes an increase in the pressure $P_1$ of the feeding circuit at the input of the motor and in the lower chamber 32 of the hydraulic jack. Because pressure $P_2$ in the upper chamber 31 of this jack is constant, being adjusted by the pressure control valve 38, this increase in the pressure $P_1$ in the lower chamber 32 relieves the grinding tool until equilibrium between the resisting torque and the bearing pressure of the grinding tool is restored. The reverse situation takes place upon decrease in the pressure of the grinder against the rail. In this case, the pressure in the lower chamber of the jack decreases, resulting in an increase in the bearing force of the grinding tool.

By such setting of the pressure $P_2$, there is thus obtained an automatic adjustment of this equilibrium between the resisting torque of the grinding tool and its bearing force on the rail.

When it comes to finishing cuts, it is useful to ensure that the bearing pressure of the grinding tools does not vary, regardless of the variations in the resisting torque of the tools.

Figure 4:
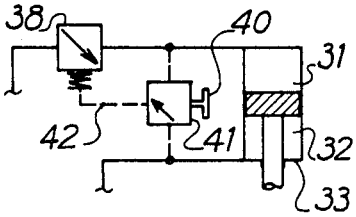

FIG. 4 illustrates a variant of the feed circuit of the hydraulic jack 32 of FIG. 3 which constitutes a second embodiment ensuring this condition of stability.

The value set here is no longer the pressure $P_2$ of the upper chamber 31 of the jack 33 but the difference in pressure $\Delta = P_1 - P_2$ from which the bearing pressure of the grinding tool directly depends. This difference in pressure is set by means of the setting member 40 of a pressure differential regulator 41 bridge-mounted on the two pipes feeding the upper and lower chambers of the jack 33. A feed-back control 42 of this regulator is connected to the adjusting member of the control valve 38 to cause variation in the output pressure $P_2$ of said valve in such a way as to hold the pressure differential $\Delta = P_1 - P_2$ constant.

Figure 5:
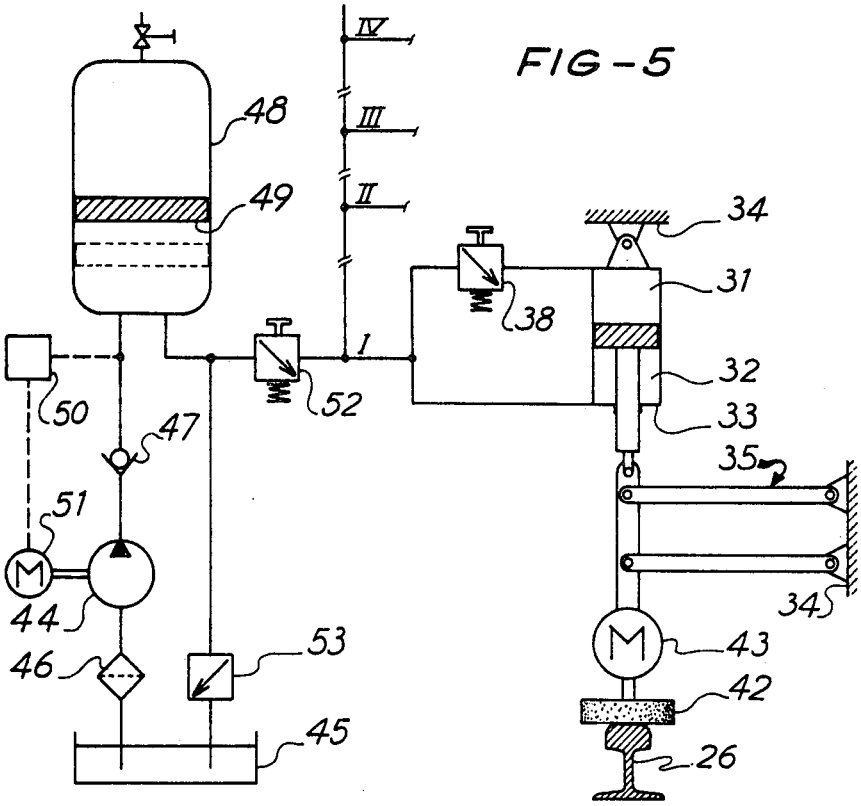

In FIG. 5, diagrammatically illustrating the third embodiment of the feeding and control circuit of the grinding tools, there is shown a grinding tool comprising a cylindrical grinder 42 driven by a synchronous electric motor 43 having a substantially constant speed of rotation.

As in the embodiment illustrated in FIG. 3, the hydraulic feed and control circuit of the grinding tool suspension jack is arranged to maintain in the upper chamber of the jack a pressure $P_2$ by means of a pressure control valve 38.

However, this hydraulic circuit is arranged here solely to hold an available pressure $P_1$. For this purpose, it has a constant capacity hydraulic pump 44 drawing fluid from a tank 45 through a filter 46 and driving it, through a check-valve 47, into a hydraulic accumulator 48 provided with a separator piston 49 and gas under pressure. An actuating-releasing device such as a pressurestat 50 is provided in the feeding circuit of the accumulator 48 and is connected to the electric motor 51 driving the pump 44 to actuate it or stop it within predetermined accumulator pressure limits greater than the desired output pressure $P_1$ of this circuit. This pressure $P_1$ is adjusted by means of a pressure regulator 52. A discharge valve 53 is provided with return to the tank as safeguard in case of circuit overload or failure of the pressurestat 50.

There is shown in this base circuit which is the energy generator for this third embodiment, connected at point I, the beginning of a branch circuit feeding at points II, III, IV other grinding tools of the type of tool 42 and motor 43 to illustrate how it is possible, by variations of the setting of the single pressure control valve 52, to vary the bearing pressure of all the tools connected to this same base circuit. Indeed, by setting the valve to a new pressure, all of the lower chambers of the suspension jacks of these tools are subjected to this new set pressure whereas the pressure in the upper chambers of the same tools remains constant. The effect of this is to increase or decrease by an equal amount, corresponding to the difference between the new and old pressures, the bearing force of all the grinding tools in question.

In the above-described three embodiments of FIGS. 3, 4 and 5, the pressure control valve 38 is mounted on the feed circuit of the upper chamber of the differential jack 33. This arrangement is advantageous since it allows relief of a grinding tool having a vertical axis, as shown in the figures, as well as loading a tool having a horizontal axis for the grinding of the inner face of a rail, as shown for the tools 20 and 21 in FIG. 1. However, this mounting is not restrictive and any other system could be applied to obtain the same result. For instance, for a tool having a horizontal axis, it is possible to mount the pressure control valve 38 on the feed pipe of the lower chamber of a double action jack.

Figure 6:
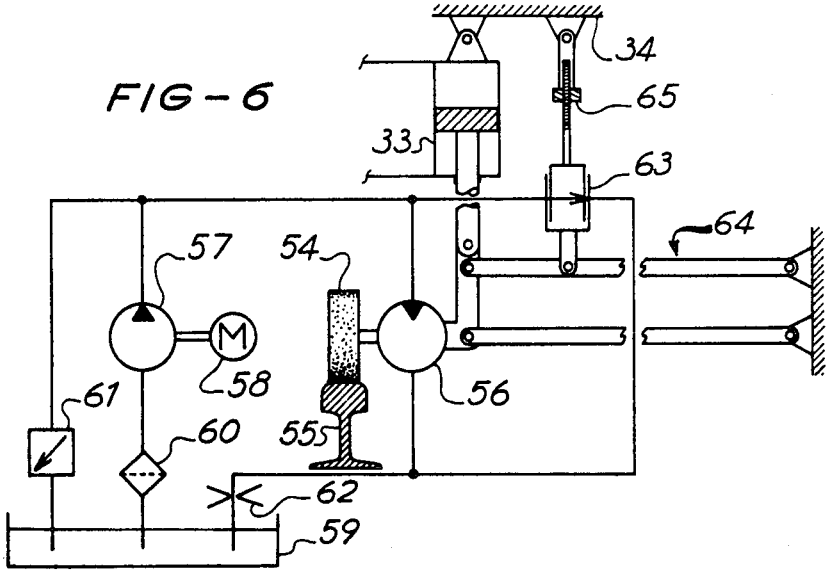
FIG. 6 is a diagrammatic illustration of a control and feed circuit for a grinding tool wherein the grinder operates at its periphery.

There is shown in FIG. 6, a grinding tool having a horizontal axis comprising a grinder 54 machining, by its periphery, a rail 55. This grinder is driven by a hydraulic motor 56 fed by a constant capacity hydraulic pump 57 itself driven by an electric motor 58. The other elements of the base circuit, i.e. tank 59, filter 60, discharge valve 61 and throttle 62 have the same functions as the same elements in the already described embodiment in FIG. 3. The feed circuit of the suspension jack 33 is not shown. It may be of the type shown in FIGS. 3 or 4, independent of or connected to the feed circuit of the grinding tool.

As the grinder 54 progressively wears out, the grinding tool moves closer to the rail while moving away from the support 34 to which it is suspended, the latter being at a fixed distance from the rail due to the fact that it is secured to the grinding unit resting on the railway through the guiding rollers.

For a constant speed of rotation of the motor 56, the peripheral speed of the grinder diminishes progressively with wear. To avoid this disadvantage, a proportional distributor or turnbuckle 63 is mounted in parallel on a branch of the hydraulic circuit interconnecting the input and the output of the hydraulic motor 56. The casing of this distributor is connected to the articulation linkage 64 of the grinding tool and its core is connected to the support 34 through a nut-and-screw adjustment device 65.

The characteristics of this proportional distributor are selected in such a way that the relative displacement of these two elements, i.e. the core and jacket, proportional to the decrease in diameter in order to ensure the constancy of its peripheral speed.

The above-described embodiments are not restrictive and the teaching of the present invention could be applied, for example, to the control of the grinding power by combining the adjustment of the rotation speed and the adjustment of the torque of the motor of the grinder. Finally, any variants could be made to the construction of the grinding train and its composition without departing from the scope of the invention.

It also goes without saying that the use of hydraulic energy, while being preferential, is not restrictive and other electrical and pneumatic sources of energy could be used as well to feed the grinding tools to control them without departing from the scope of the invention.

What is claimed is:

1. A process for on-track truing of the surfaces of the head of a rail of a railway wherein a predetermined number of grinding tools, angularly oriented in a plane normal to said rail and each operating along a tangent to the profile of the head of said rail, are moved at generally constant longitudinal speed along the generatrices of said surfaces, said process comprising effecting rotational drive of said grinding tools to grind the profile of the head of said rail, relating the value of at least one of the parameters affecting the metal removing ability of at least one of the grinding tools to a predetermined control value which is pre-determined as a function of the desired cutting depth of the said tool and controlling the bearing pressure of said at least one grinding tool by regulation in a closed feed-back loop of the bearing pressure of the tool as a function of the rotational drive of the grinding tool.

2. A process according to claim 1 wherein the selected parameter affecting the metal removing ability of all of the grinding tools working on the same stretch of rails is governed by the same control value.

3. A grinding train for on-track truing of the surfaces of the head of a rail comprising at least one grinding vehicle including a power unit and a predetermined number of grinding tools for truing the profile of the head of the rail, at least one feed circuit connecting the grinding tools to said power unit for effecting rotational drive of said tools from said power unit and comprising means for controlling the operation of said tools by relating the value of at least one parameter affecting the metal removing capacity of at least one of said grinding tools to a control value which is pre-established as a function of the desired cutting depth of the said tool, said means comprising a member for setting said control value, and closed feedback circuit means between the power unit and said at least one grinding tool for controlling the bearing pressure of the tool and thereby the metal removing capacity thereof as a function of the rotational drive of the tool.

4. A grinding train according to claim 3 wherein each grinding tool has a hydraulic drive motor, a hydraulic jack suspending each tool from the grinding vehicle, said feed circuit comprising a hydraulic circuit including a tank, a filter, and a hydraulic pump feeding fluid at a generally constant pressure $P_1$ to the hydraulic motor of each grinding tool, said jack having upper and lower chambers, said hydraulic circuit joining the pump and the motor of each grinding tool, on the one hand, to the lower chamber and, on the other hand, to the upper chamber of said hydraulic jack to which the said grinding tool is suspended, said means for controlling the operation of said tools comprising a pressure control valve in said circuit between one of the two chambers of said jack and said pump, said member for setting said control valve comprising a member of said pressure control valve for setting a control pressure $P_2$ which is a function of the desired bearing force for said grinding tool on the head of the rail.

5. A grinding train according to claim 4 comprising control means for adjusting the setting members of a predetermined group of grinding tools simultaneously to a common value, said control means comprising a member for setting a new value and a control circuit connecting the latter said setting member and all of the setting members of the controlling means.

6. A grinding train according to claim 4 wherein said means further comprises a differential pressure regulator bridge connected in said circuit between the lower and upper chambers of said hydraulic jack, said differential regulator comprising means for setting a control pressure differential ($\Delta = P_1 - P_2$) which is a function of the desired bearing force of the said grinding tool on the head of the rail, and a feedback control circuit connecting the setting member of the valve controlling the pressure of the jack of each grinding tool to said differential pressure regulated bridge.

7. A grinding train according to claim 6 comprising control means for adusting the setting members of a predetermined group of grinding tools simultaneously to a common value, said control means comprising a member for setting a new value and a control circuit connecting the latter said setting member and all of the setting members of the controlling means.

8. A grinding train according to claim 4 wherein at least one grinding tool comprises a grinder having an operative peripheral surface, said feed circuit of said tool including means for controlling the peripheral speed of said grinder comprising means responsive to variations in diameter of the said grinder caused by wear, and means coupled to said responsive means for varying the rotation speed of the grinder in response thereto.

9. A grinding train according to claim 8 comprising control means for adjusting the setting members of a predetermined group of grinding tools simultaneously to a common value, said control means comprising a member for setting a new value and a control circuit connecting the latter said setting member and all of the setting members of the controlling means.

10. A grinding train according to claim 6 wherein at least one grinding tool comprises a grinder having an operative peripheral surface, said feed circuit of said tool including means for controlling the peripheral speed of said grinder comprising means responsive to variations in diameter of the said grinder caused by wear, and means coupled to said responsive means for varying the rotation speed of the grinder in response thereto.

11. A grinding train according to claim 10 comprising control means for adjusting the setting members of a predetermined group of grinding tools simultaneously to a common value, said control means comprising a member for setting a new value and a control circuit connecting the latter said setting member and all of the setting members of the controlling means.

12. A process as claimed in claim 1 wherein the parameter affecting the metal removing ability of the grinding tool is bearing force, the tool being pressed against the rail by a jack one of whose chambers is fed with fluid at constant pressure regulated by said control value, the other chamber being fed with fluid at a pressure controlled by a motor producing said rotational drive of the tool and cooperating in feed-back circuit relation with the said other chamber of the jack.

* * * * *